US011614302B1

(12) United States Patent
Lung et al.

(10) Patent No.: US 11,614,302 B1
(45) Date of Patent: Mar. 28, 2023

(54) COMPRESSED AIR GUN TRIGGER STRUCTURE

(71) Applicant: LCS AIR ARMS LLC, Greensboro, NC (US)

(72) Inventors: Ho Yin Alien Lung, Greensboro, NC (US); Lai Mei Ip, Greensboro, NC (US)

( * ) Notice: Subject to any disclaimer, the term of this patent is extended or adjusted under 35 U.S.C. 154(b) by 0 days.

(21) Appl. No.: 17/563,408

(22) Filed: Dec. 28, 2021

(51) Int. Cl.
*F41B 11/646* (2013.01)

(52) U.S. Cl.
CPC ..... *F41B 11/646* (2013.01)

(58) Field of Classification Search
CPC ..... F41B 11/646; F41B 11/647; F41B 11/648; F41B 11/721; F41B 11/723
USPC ..... 124/66, 67, 71, 76
See application file for complete search history.

(56) References Cited

U.S. PATENT DOCUMENTS 1,862,697 A * 6/1932 Mihalyi ..... F41B 11/51 124/40
2,301,653 A * 11/1942 Wells ..... F41B 11/723 124/75
4,899,717 A * 2/1990 Rutten ..... F41B 11/00 124/66
6,003,503 A * 12/1999 Johnson ..... F41B 9/0018 124/71
2007/0267005 A1* 11/2007 Yeh ..... F41B 11/721 124/74
2008/0099005 A1* 5/2008 Kaakkola ..... F41B 11/73 124/71
2022/0099404 A1* 3/2022 Sullivan ..... F41B 11/62

* cited by examiner

*Primary Examiner* — Bret Hayes
(74) *Attorney, Agent, or Firm* — Ashley D. Johnson; Dogwood Patent and Trademark Law

(57) ABSTRACT

A compressed air gun trigger structure, the air refill lock cooperates with the trigger assembly to facility full auto and semi auto shooting. That is while the pressure of the eject chamber is lower than the set scale, the air refill lock will lock the piston even though the trigger is triggered by user. So the compressed air gun cannot be fired when the pressure is low. When the eject chamber is fully refilled and the pressure will push the air refill lock to releases the trigger and while user triggered the trigger, the compressed air gun is fired. That is the semi-auto mode. If the user keep holding the trigger, air refill lock will automatically trigger the piston for firing when the eject chamber is fully refilled. That is the full-auto mode.

10 Claims, 7 Drawing Sheets

COMPRESSED AIR GUN TRIGGER STRUCTURE

FIELD OF THE INVENTION

The present invention involves parts of the compressed air gun, especially a trigger structure.

BACKGROUND OF THE INVENTION

Air gun is a gun that fires projectiles pneumatically with compressed air. In contrast to a firearm, it use compressed air to eject projectiles, and the source of kinetic energy does not involve chemical reactions. Air guns can produce gas pressure much lower than firearms (50 times atmospheric pressure vs. several thousand times atmospheric pressure), so the power of air guns is usually much weaker than firearms.

Due to the complicated structure of the gas path in the air gun, most of the air gun is single-stroke. And the higher the shot speed, the higher pressure must be equipped. But the structure is hard to withstand high pressure and cause perishable, poor stability.

SUMMARY OF THE INVENTION

In view of the aforesaid drawbacks of the prior art, the present invention provides a compressed air gun trigger structure for facility full auto and semi auto shooting.

So, the present invention provides:

A compressed air gun trigger structure, comprising a compressed air chamber which is connected with a compressed air supplier; the compressed air chamber is separated into at least a pressure lock chamber and an eject chamber, the compressed air passes through the pressure lock chamber and then enters the eject chamber; a pressure lock is set and slide along the pressure lock chamber; the pressure lock blocks the air channel between the pressure lock chamber and the eject chamber pressed air when the gun is fired and then springs back to let air refill the eject chamber; the eject chamber provides with an air outlet which is aligned with the bullet; and a piston which is sliding along the eject chamber, locked by a trigger assembly to block the outlet while not firing; the trigger assembly comprising at least a trigger and an air refill lock; the trigger provides a locking protrude which is connected with the piston while not firing; the air refill lock holds the trigger to lock the piston while the pressure in the compressed air chamber is lower than set scale, and releases the trigger while the pressure is higher than set scale.

Further, the trigger comprising a trigger part and a piston lock which are separately pivot installed to the compressed air chamber; the locking protrude is set on the piston lock; the trigger part holds the piston lock in lock status by stopping the rotation of the piston lock, and releases the piston lock in unlock status to let the piston lock rotate; the air refill lock holds rotation of the piston lock while the pressure in the compressed air chamber is lower than set scale, and releases the piston lock while the pressure is higher than set scale.

Further, wherein the trigger part provides a notching I for holding the end of the piston lock; while the trigger is triggered, the trigger rotates and the end of the piston lock is detached from the notching I, then unlock the piston for firing the bullet.

Further, the air refill lock is composed of a slider and a refill lock body, the slider is installed in a refill control chamber; and a spring 35 is provided for holding the slider while the pressure is lower than the elastic force of the spring; the refill lock body provides a notching II for holding the end of the piston lock; while the pressure is higher than elastic force of the spring, the slider moves and the refill lock body rotates to let the end of the piston lock is detached from the notching II.

Further, the compressed air supplier connects to an air path which includes an air valve for pressure controlling; the outlet of the air path connects to the pressure lock chamber.

Further, the air refill chamber which connects the pressure lock chamber and the eject chamber to let the pressure balance after firing and the pressure lock springs back to open the air channel between the pressure lock and the eject chamber.

Further, the trigger assembly comprising a fire mode lock, the fire mode lock includes a fire mode lock body which is pivot installed together with the trigger, a movable holder which is pivot installed on the trigger and a mode switch which provides a knob to lock/hold/release the fire mode lock body for the safe/auto/semi-auto mode; the fire mode lock body provides a notching III for holding the end of the piston lock.

Further, under semi-auto mode is set, when the trigger part rotates, the movable holder holds the fire mode lock body rotating together with the trigger to unlock the piston for firing the bullet; the piston provides a pole for pushing the movable holder to disengage the fire mode lock body from the trigger.

Further, the comprising a bullet wheel which is driven by compressed air; the bullet wheel includes a wheel for holding bullets along its rim, and a wheel push device; the wheel push device includes a pump which is connected with the compressed air chamber, a pawl which is driven by the pump and is reset by a return spring, a ratchet which is set around the wheel and cooperates with the pawl; when the pressure of the pump raises over the elastics force of the return spring, the pump drives the pawl and pushes the wheel rotate for the next bullet; when the pressure of the pump drops down to lower than the elastics force of the return spring, the return spring push the pawl back.

Further, the pump provides a pump lock which includes a handle for stopping the movement of the pump.

The present invention has the following advantages: the air refill lock cooperates with the trigger assembly to facility full auto and semi auto shooting. That is while the pressure of the eject chamber is lower than the set scale, the air refill lock will lock the piston even though the trigger is triggered by user. So the compressed air gun cannot be fired when the pressure is low. When the eject chamber is fully refilled and the pressure will push the air refill lock to releases the trigger and while user triggered the trigger, the compressed air gun is fired. That is the semi-auto mode. If the user keep holding the trigger, air refill lock will automatically trigger the piston for firing when the eject chamber is fully refilled. That is the full-auto mode.

BRIEF DESCRIPTION OF THE DRAWINGS

Below are explanations of the invention combining with drawings.

In the figures: 1. the pressure lock chamber, 2. the eject chamber, 3. pressure lock, 4.the air channel, 5.the air outlet, 6.the bullet, 7. the piston, 8.the locking protrude, 9.the trigger part, 10.the piston lock, 11.the notching I, 12. the trigger, 13.the slider, 14.the refill lock body, 15.the refill control chamber, 16. the notching II, 17.the piston return spring, 18. the fire mode lock body, 19. the notching III, 20. the mode switch, 21. the knob, 22. the pole, 23. the wheel, 24. the pump, 25. the pawl, 26. the ratchet, 27. the handle, 28. the notching IV, 29. the bullet wheel push device return spring, 30. the air path, 31. the air valve. 32. the pressure lock return spring, 33. the air refill chamber, 34. the compressed air supplier, 35. the spring for holding the slider, 36. the movable holder.

DESCRIPTION OF THE EMBODIMENTS

Refer to FIG. 1 to FIG. 4, the compressed air gun trigger structure, comprising a compressed air chamber and a compressed air supplier 34. The compressed air supplier 34 usually is a compressed air tank which is easy for carrying and can be refilled. It is the power for the gun's operation. The compressed air chamber includes a pressure lock chamber 1 and an eject chamber 2.

Figure 1:
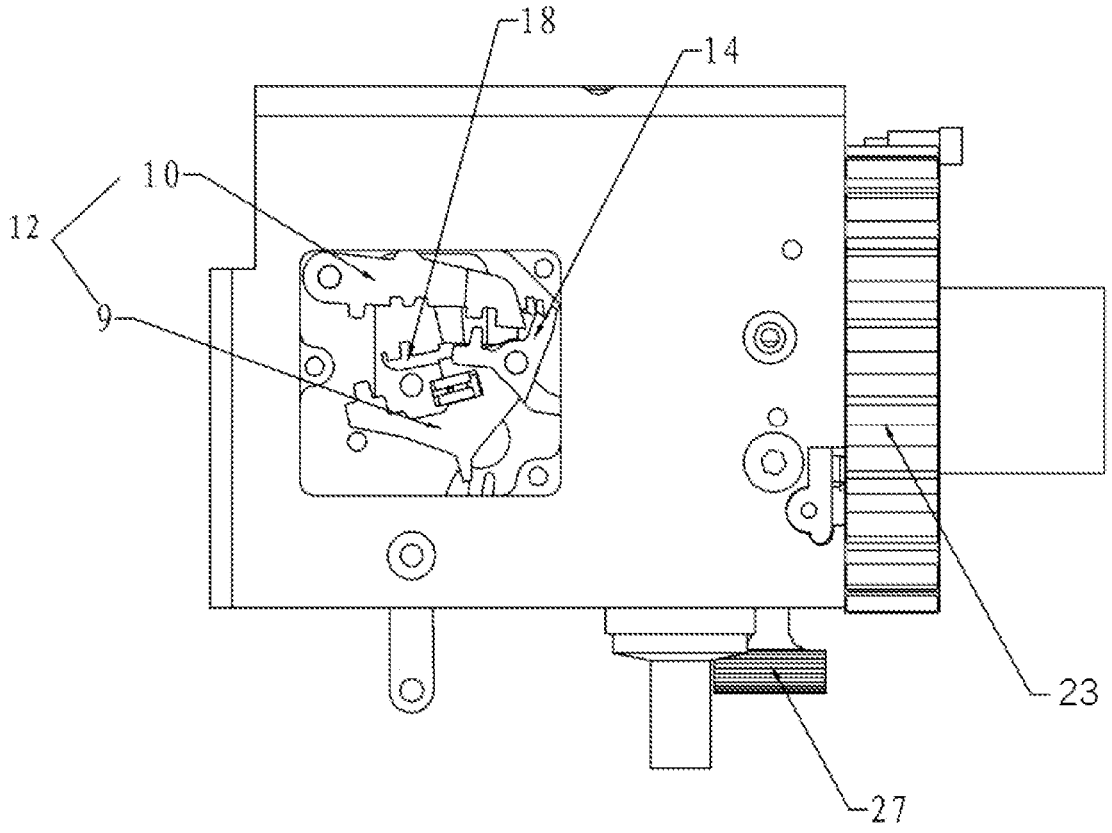
FIG.1 is the front view of the present invention.
Figure 2:
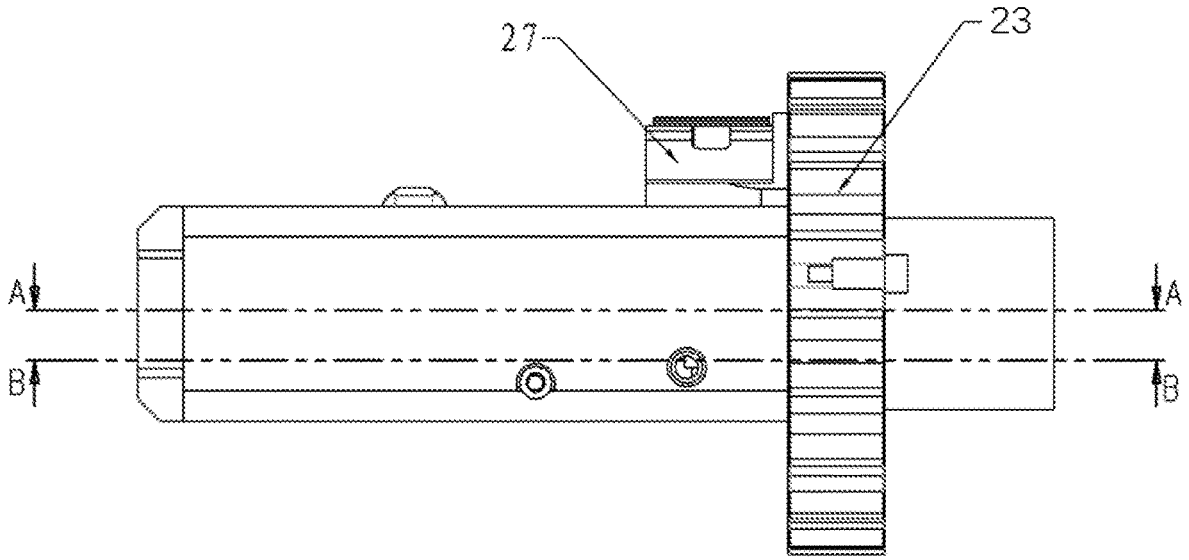
FIG. 2 is the top view of the present invention.
Figure 3A:
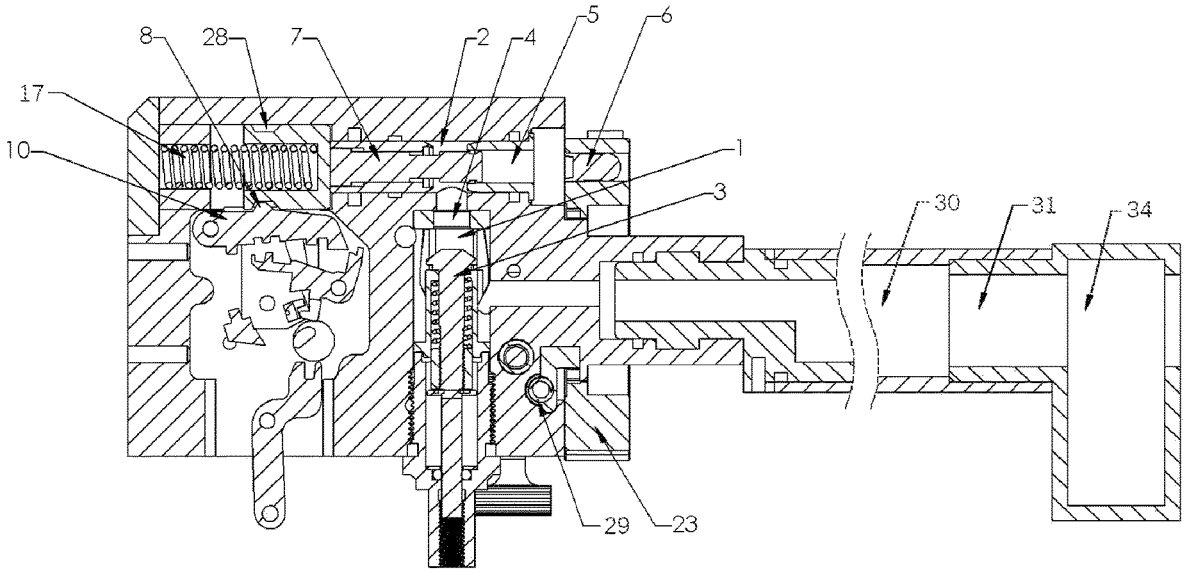
FIG. 3*a* is a side view of the invention comprising an air supplier.
Figure 3B:
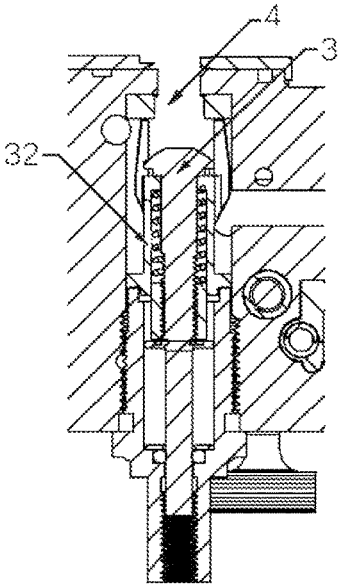
FIG. 3*b* is a sectional view of the eject chamber of FIG. 3*a*.
Figure 3C:
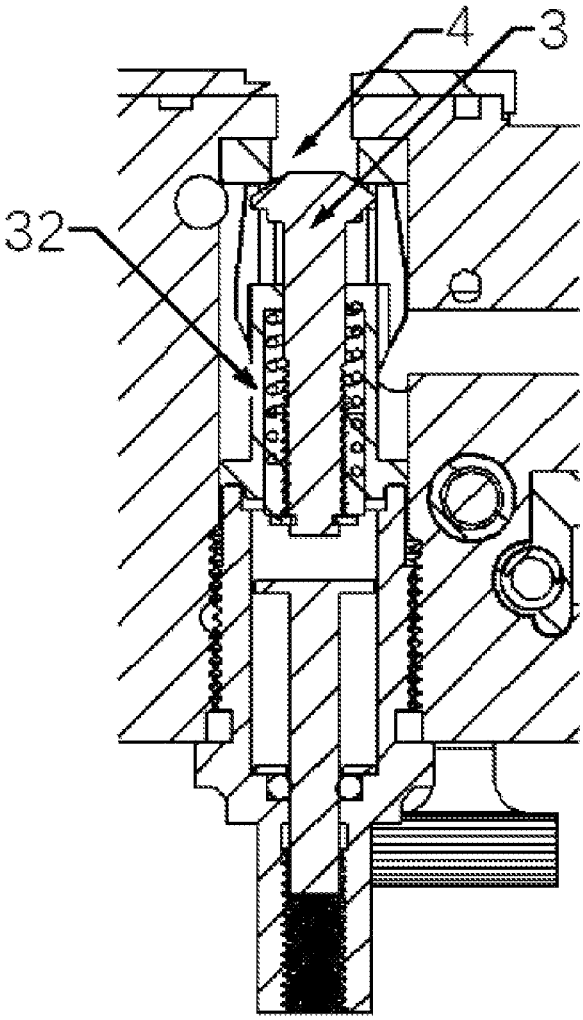
FIG. 3*c* is a sectional view of the eject chamber of FIG. 3*a*.

Refer to FIGS. 3*a*-3*c*, inside the eject chamber 2, it provides an air outlet 5 and a piston 7. The air outlet 5 is aligned with the bullet 6. So while the air outlet 5 is opened, the compressed air will get through and push the bullet 6 out of the gun. The air outlet 5 is open or not which is controlled by the piston 7. And the piston 7 is controlled by the trigger assembly. Generally the air outlet 5 is blocked by the piston 7, but while the eject chamber 2 is filled with compressed air in set scale and the user triggers the trigger 12, the piston 7 will move backward to let the air outlet 5 open for firing the bullet 6. After firing, the pressure is dropped and the piston 7 will move forward by a spring 17 to block the air outlet 5 for the next shot.

Refer to FIGS. 3*a*-3*c* and FIG. 4, the pressure lock chamber 1 is provided for controlling the refill of the eject chamber 2. While the bullet 6 is fired, the air outlet 5 will keep open in a short while and the compressed air in the eject chamber 2 keeps releasing. That makes waste of compressed air. So the compressed air pass through the pressure lock chamber 1 and then enter the eject chamber 2. There is a pressure lock 3 setting and sliding along the pressure lock chamber 1 for opening or blocking the air channel 4 between the pressure lock chamber 1 and the eject chamber 2. When the trigger mechanism is triggered, the piston 7 will be unlocked and pushed back under the pressure force of the eject chamber 2. The air outlet 5 will be opened to release the air from the eject chamber 2 and the pressure lock chamber 1. When the pressure force of the pressure lock chamber 1 is larger than the pressure force of the eject chamber 2 plus the force of the pressure lock return spring 32, the pressure lock will be pushed to close the air channel 4. When the pressure of the eject chamber 2 instantly reduces, the piston 7 will close the air outlet 5 by the force of the piston return spring 17. The air refill chamber 33 supplies air into the pressure lock chamber 1 and the eject chamber 2. When the pressure force of the pressure lock chamber 1 is less than the pressure force of eject chamber 2 plus the force of the pressure lock return spring 32, the pressure lock 3 then springs back and opens the channel 4.

Figure 5:
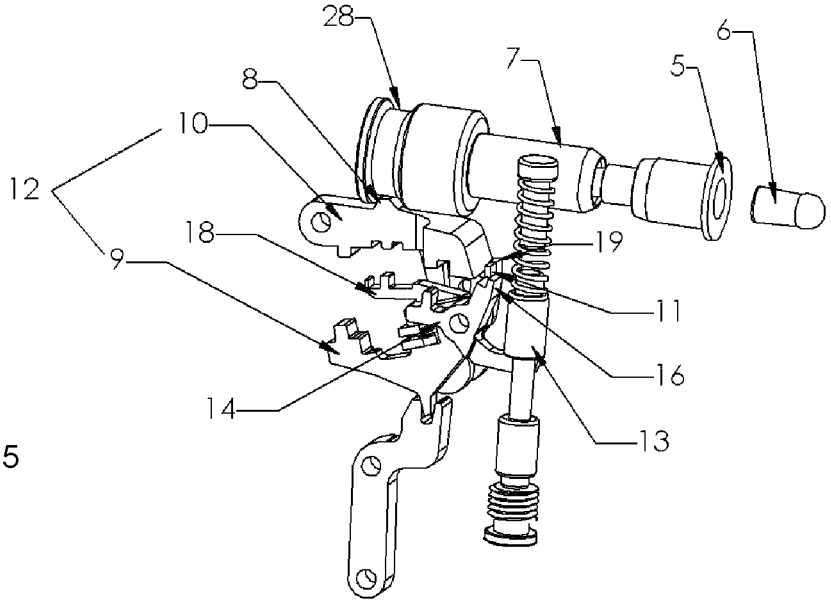
FIG.5 is the first perspective view of the trigger assembly.
Figure 6:
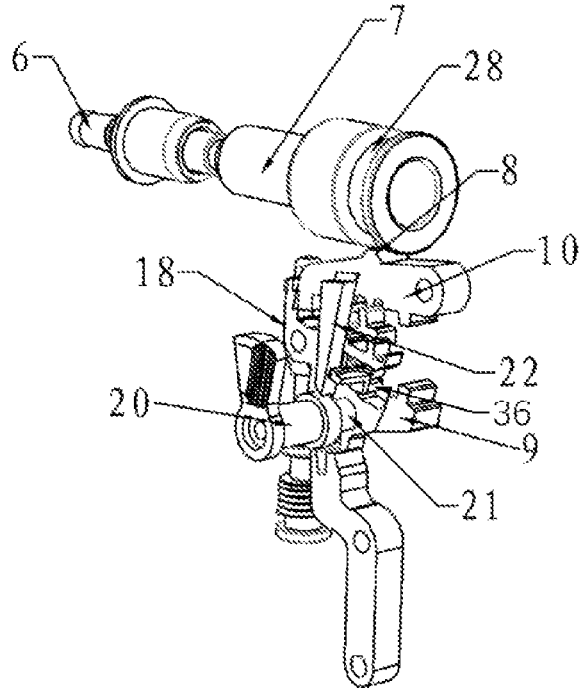
FIG.6 is the second perspective view of the trigger assembly.

Refer to FIG. 5 and FIG. 6, the trigger assembly includes a trigger 12 and an air refill lock. The trigger 12 connects to the piston 7 for controlling the fire. The air refill lock holds the trigger 12 to lock the piston 7 while the pressure in the eject chamber 2 is lower than set scale even though the trigger 12 is triggered by user. So the compressed air gun cannot be fired when the pressure is low. When the eject chamber 2 is fully refilled and the pressure will push the air refill lock to releases the trigger 12 and while user triggered the trigger 12, the compressed air gun is fired.

The trigger 12 can be separated into a trigger part 9 and a piston lock 10. The trigger part 9 connects to the piston lock 10. The trigger part 9 and the piston lock 10 are pivotally installed. A locking protrude 8 is set on the piston lock 10, a notching IV 28 is set next to the piston 7, and the locking protrude 8 matches with the notching IV 28 to lock or unlock the piston 7. The trigger part 9 also provides a notching I 11 for holding the end of the piston lock 10. Generally, the notching I 11 of the trigger part 9 holds the end of the piston lock 10 in lock status by stopping the rotation. While the user pulls the trigger part 9, the trigger part 9 rotates, drives the piston lock 10 to rotate and the locking protrude 8 detaches from the notching IV 28, so the piston 7 can opens the air outlet 5 to fire bullet 6.

Figure 4:
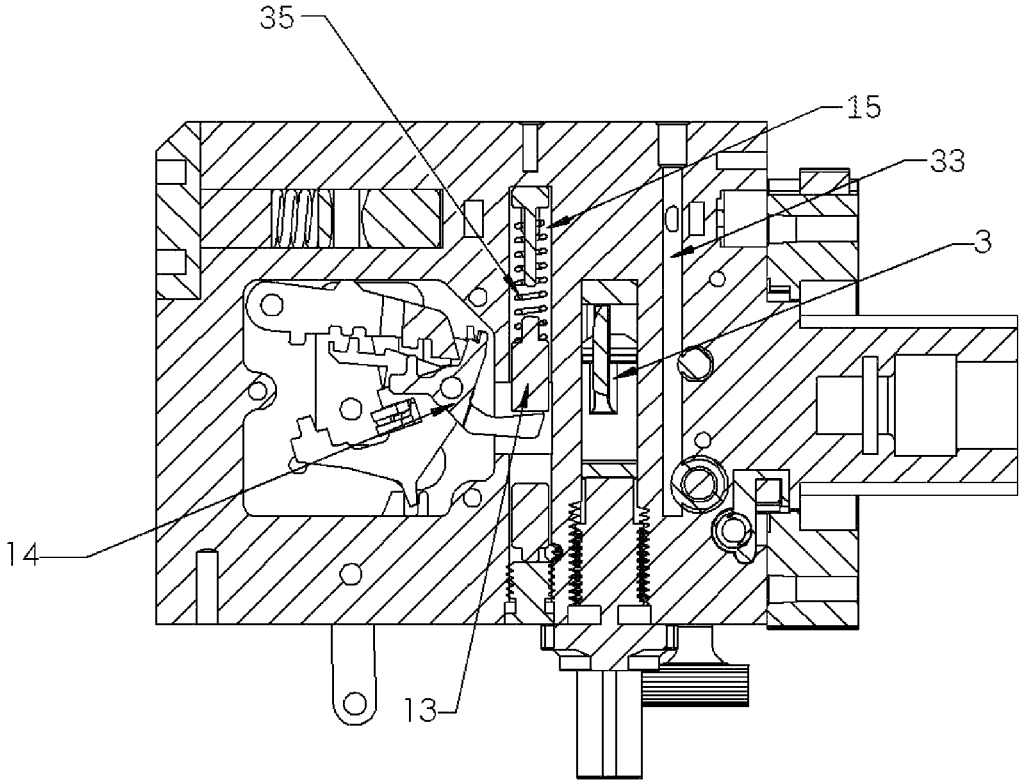
FIG.4 is the B-B section view of FIG. 2.

Refer to FIG. 4, the air refill lock is composed of a slider 13 and a refill lock body 14. The slider 13 is installed in a refill control chamber 15 and slides along. A spring 35 is provided and holds the slider 13 while the pressure is lower than the elastic force of the spring 35. The refill lock body 14 connects with the slider 13. The refill lock body 14 provides a notching II 16 for holding the end of the piston lock 10. While the pressure is higher than elastic force of the spring 35, the slider 13 moves and the refill lock body 14 rotates to let the end of the piston lock 10 is detached from the notching II 16. That means the piston 7 is unlocked by the refill lock body 14. User can pull trigger 12 for firing. Otherwise, the slider 13 holds the refill lock body 14 to lock the piston lock 10 by notching II 16.

According to the usage, user can adjust the muzzle energy as requirement. The higher pressure of compressed air in the eject chamber 2 the higher muzzle energy. For convenient of pressure adjustment to user, the compressed air supplier 34 connects to an air path 30 which includes an air valve 31 for pressure adjustment. The outlet of the air path 30 connects to the pressure lock chamber 1.

Refer to FIG. 5 and FIG. 6, the compressed air gun can be set working in different mode for user selection: safe, auto and semi-auto. This function is achieved by setting a fire mode lock and its related mechanical structure. The fire mode lock includes a fire mode lock body 18. It is pivot installed together with the trigger 12 and the structure is very similar with the refill lock body 14 and the trigger part 9. It also provides a notching III 19 for holding the end of the piston lock 10. A mode switch 20 is provided on the outer surface for user selecting different mode. Inside, the mode switch 20 provides a knob 21 which can lock, hold or release the fire mode lock body 18 to access safe, auto, or semi-auto mode. By turning the knob 21, it will lock or unlock the rotation of the fire mode lock body 18 to let the notching III 19 lock or unlock the piston lock 10 in safe or auto mode.

Figure 7:
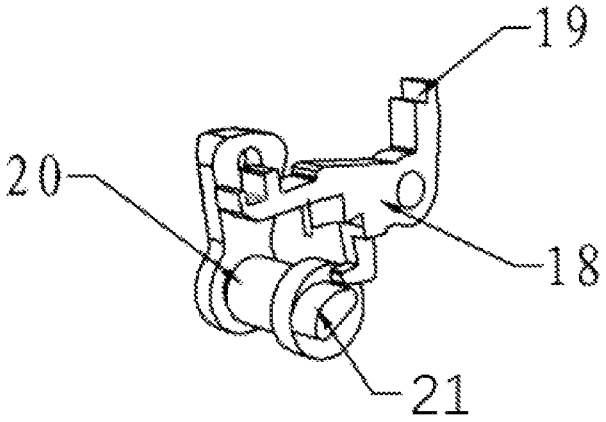
FIG.7 is the perspective view of the mode switch together with the fire mode lock body.

Refer to FIG. 6 and FIG. 7, but for the semi-auto mode, there must be more mechanic to cooperate with the trigger part 9. That is the movable holder 36. It is pivot installed on the trigger 12. When the semi-auto mode is set and the trigger part 9 rotates, the movable holder 36 holds the fire mode lock body 18 rotating together with the trigger part 9 to unlock the piston 7. And the piston 7 provides a pole 22 for pushing the movable holder 36 to disengage the fire mode lock body 18 from the trigger part 9. Then the fire mode lock body 18 is reset and notching III 19 locks the piston lock 10 to hold the fire. So, even though the user keep holding the trigger part 9, the gun will only fire once. If user needs to fire the next bullet 6, he must release the trigger part 9 to let the movable holder 36 hold the fire mode lock body 18 again, then repeat above shooting operation.

Figure 8:
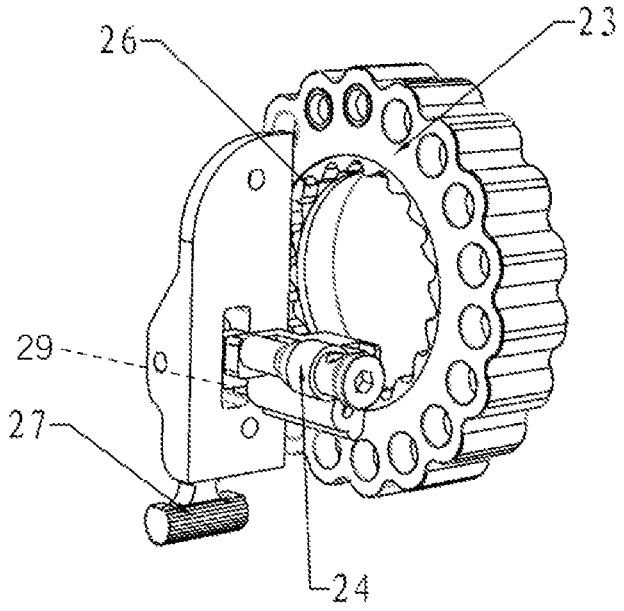
FIG.8 is the first perspective view of the bullet wheel.
Figure 9:
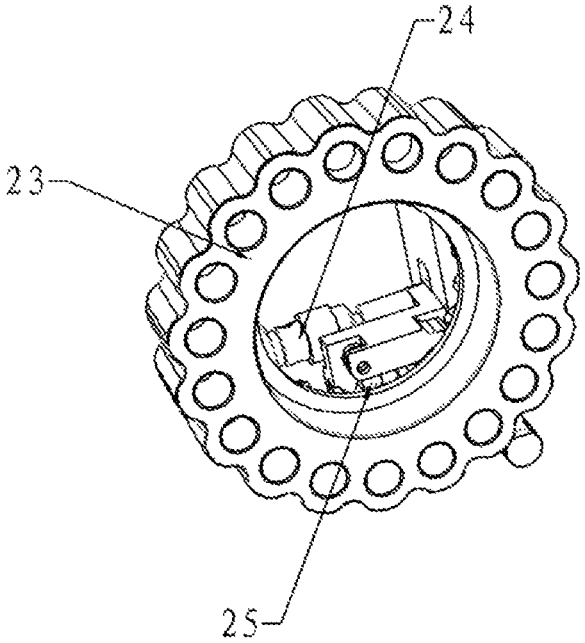
FIG.9 is the second perspective view of the bullet wheel.

Refer to FIG. 8 and FIG. 9, the present invention also provides an automatic bullet wheel. It is also driven by the compressed air. The bullet wheel includes a wheel 23 for holding bullets along its rim, and a wheel push device. The wheel push device includes a pump 24 which is connected with the compressed air chamber, a pawl 25 which is driven by the pump 24 and is reset by a return spring 29, and a ratchet 26 which is set around the wheel and cooperates with the pawl 25. When the pressure of the pump 24 rises over the elastics force of the return spring 29, the pump 24 drives the pawl 25 and pushes the wheel rotate for the next bullet. And when the pressure of the pump 24 drops down to lower than the elastics force of the return spring 29, the return spring 29 push the pawl 25 back.

If user doesn't want bullet wheel works automatically, a pump lock is provided. It includes a handle 27 for stopping the movement of the pump 24.

What is claimed is:

1. A compressed air gun trigger structure comprising a compressed air chamber which is connected with a compressed air supplier;

the compressed air chamber comprises a pressure lock chamber and an eject chamber, wherein compressed air fills both the pressure lock chamber and the eject chamber;

a pressure lock is set in a first position and slides along the pressure lock chamber to a second position; the pressure lock blocks an air channel between the pressure lock chamber and the eject chamber when a gun comprising the compressed air gun trigger is fired, wherein when a pressure force of the pressure lock chamber is less than a pressure force of the eject chamber plus a force of a pressure lock return spring, the pressure lock then springs back and opens the air channel;

a piston is positioned between the eject chamber and the air outlet which is aligned with a bullet; wherein the piston is configured to slide along the eject chamber in response to a pressure force in a first direction and is locked by a trigger assembly to block the air outlet while not firing in a second direction;

the trigger assembly comprising at least a trigger and an air refill lock; the trigger provides a locking protrusion which is connected with the piston while not firing;

the air refill lock holds the trigger to lock the piston while pressure in the compressed air chamber is lower than a predetermined threshold, and releases the trigger while the pressure is higher than the predetermined threshold.

2. The compressed air gun trigger structure of claim 1, wherein the trigger comprises a trigger part and a piston lock which are separately pivotally installed to the compressed air chamber; the locking protrusion is set on the piston lock; the trigger part holds the piston lock in lock status by stopping a rotation of the piston lock, and releases the piston lock in unlock status to let the piston lock rotate; the air refill lock holds rotation of the piston lock while a pressure in the compressed air chamber is lower than the predetermined threshold and releases the piston lock while the pressure is higher than the predetermined threshold.

3. The compressed air gun trigger structure of claim 2, wherein the trigger part provides a notching I for holding an end of the piston lock; while the trigger is activated to fire the gun, the trigger rotates and the end of the piston lock is detached from the notching I, then unlocks the piston for firing the bullet.

4. The compressed air gun trigger structure of claim 2, wherein the air refill lock is composed of a slider and a refill lock body, the slider is installed in a refill control chamber; the refill lock body connects with the slider; and a spring is provided for holding the slider while the pressure is lower than the elastic force of the spring; the refill lock body provides a notching II for holding an end of the piston lock; while the pressure is higher than elastic force of the spring, the slider moves and the refill lock body rotates to let the end of the piston lock detach from the notching II.

5. The compressed air gun trigger structure of claim 1, wherein the compressed air supplier connects to an air path which includes an air valve for pressure controlling, an outlet of the air path connects to the pressure lock chamber.

6. The compressed air gun trigger structure of claim 1, wherein the air refill chamber which connects the pressure lock chamber and the eject chamber to let the pressure balance after firing and the pressure lock springs back to open the air channel between the pressure lock chamber and the eject chamber.

7. The compressed air gun trigger structure of claim 6, wherein when semi-auto mode is set, and the trigger rotates, a movable holder holds a fire mode lock body rotating together with the trigger to unlock the piston for firing the bullet; the piston provides a pole for pushing the movable holder to disengage the fire mode lock body from the trigger.

8. The compressed air gun trigger structure of claim 1, wherein the trigger assembly comprising a fire mode lock, the fire mode lock includes a fire mode lock body which is pivotally installed together with the trigger, a movable holder which is pivotally installed on the trigger and a mode switch which provides a knob to lock/hold/release the fire mode lock body for a safe/auto/semi-auto mode; the fire mode lock body provides a notching III for holding an end of the piston lock.

9. The compressed air gun trigger structure of claim 7, wherein a pump provides a pump lock which includes a handle for stopping movement of the pump.

10. The compressed air gun trigger structure of claim 1, comprising a bullet wheel which is driven by compressed air; the bullet wheel holds bullets along a rim of the wheel, and a wheel push device; the wheel push device includes a pump which is connected with the compressed air chamber, a pawl which is driven by the pump and is reset by a return spring, a ratchet which is set around the wheel and cooperates with the pawl; when a pressure of the pump raises over an elastics force of the return spring, the pump drives the pawl and pushes the wheel to rotate for a next bullet; when the pressure of the pump drops down to lower than the elastics force of the return spring, the return spring push the pawl back.

* * * * *